US011652294B2

(12) United States Patent
Luo et al.

(10) Patent No.: US 11,652,294 B2
(45) Date of Patent: *May 16, 2023

(54) DUAL-BAND ANTENNA

(71) Applicant: HUAWEI TECHNOLOGIES CO., LTD., Guangdong (CN)

(72) Inventors: Xin Luo, Chengdu (CN); Hongyong Lin, Shenzhen (CN); Zhili Guo, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 143 days.

This patent is subject to a terminal disclaimer.

(21) Appl. No.: 17/101,826

(22) Filed: Nov. 23, 2020

(65) Prior Publication Data

US 2021/0083385 A1 Mar. 18, 2021

Related U.S. Application Data

(63) Continuation of application No. 16/134,519, filed on Sep. 18, 2018, now Pat. No. 10,916,849, which is a (Continued)

(51) Int. Cl.
*H01Q 5/55* (2015.01)
*H01Q 19/10* (2006.01)
(Continued)

(52) U.S. Cl.
CPC ..... *H01Q 5/55* (2015.01); *H01Q 5/47* (2015.01); *H01Q 13/06* (2013.01); *H01Q 19/10* (2013.01); *H01Q 19/19* (2013.01)

(58) Field of Classification Search
CPC H01Q 5/47; H01Q 5/55; H01Q 19/10; H01Q 19/19; H01Q 13/02–06
See application file for complete search history.

(56) References Cited

U.S. PATENT DOCUMENTS 4,740,795 A 4/1988 Seavey
4,998,113 A * 3/1991 Raghavan ..... H01Q 5/47 333/135
(Continued)

FOREIGN PATENT DOCUMENTS

CN 102394374 A 3/2012
CN 103490167 A 1/2014
(Continued)

OTHER PUBLICATIONS

Extended European Search Report issued in European Application No. 17893209.1 dated Mar. 29, 2019, 14 pages.
(Continued)

*Primary Examiner* — Hasan Islam
(74) *Attorney, Agent, or Firm* — Fish & Richardson P.C.

(57) ABSTRACT

The present disclosure relates to coaxial dual-band antennas. One example antenna includes a waveguide tube, a ring groove, and a high frequency feed. The waveguide tube has a tubular structure and is configured to transmit a first electromagnetic wave. The ring groove whose opening direction is the same as an output direction of the first electromagnetic wave is on a wall of the waveguide tube. A frequency of the first electromagnetic wave is lower than a frequency of an electromagnetic wave transmitted by the high frequency feed. The high frequency feed is located in the waveguide tube and has a same axis with the waveguide tube.

16 Claims, 8 Drawing Sheets

Related U.S. Application Data continuation of application No. PCT/CN2017/072085, filed on Jan. 22, 2017.

(51) Int. Cl.

| | |
|---|---|
| ***H01Q 13/06*** | (2006.01) |
| ***H01Q 5/47*** | (2015.01) |
| ***H01Q 19/19*** | (2006.01) |

(56) References Cited

U.S. PATENT DOCUMENTS

| | | | | |
|---|---|---|---|---|
| 5,041,840 | A | 8/1991 | Cipolla et al. | |
| 5,793,334 | A | 8/1998 | Anderson et al. | |
| 5,907,309 | A | 5/1999 | Anderson et al. | |
| 6,577,283 | B2 | 6/2003 | Wu et al. | |
| 6,677,911 | B2 * | 1/2004 | Moheb | H01Q 1/247 343/756 |
| 6,700,549 | B2 | 3/2004 | Holzman et al. | |
| 7,079,079 | B2 * | 7/2006 | Jo | H01Q 9/0421 343/702 |
| 7,379,030 | B1 | 5/2008 | Lier | |
| 9,966,648 | B2 | 5/2018 | Liu et al. | |
| 2008/0297428 | A1 | 12/2008 | Wu | |
| 2011/0291903 | A1 | 12/2011 | Shea et al. | |
| 2015/0214616 | A1 | 7/2015 | Rogers et al. | |
| 2016/0226150 | A1 | 8/2016 | Paleta et al. | |

FOREIGN PATENT DOCUMENTS

| | | | |
|---|---|---|---|
| CN | 104600435 | A | 5/2015 |
| CN | 104901020 | A | 9/2015 |
| CN | 105428815 | A | 3/2016 |
| DE | 102013011651 | | 1/2015 |
| JP | S6095710 | | 5/1985 |
| JP | H02262702 | | 10/1990 |

OTHER PUBLICATIONS

International Search Report and Written Opinion issued in International Application No. PCT/CN2017/072085 dated May 12, 2017, 12 pages.

Office Action issued in Chinese Application No. 201780014019.3 dated Oct. 21, 2020 6 pages (with English translation).

Office Action issued in Chinese Application No. 201780014019.3 dated Oct. 9, 2019, 14 pages (with English translation).

Office Action issued in Japanese Application No. 2019-506088 dated Nov. 25, 2019, 9 pages (with English translation).

Perov et al., "Design and optimization of tri-band coaxial feed horn for the radio telescope antenna," 2013 IX International Conference on Antenna Theory and Techniques, IEEE, XP055573227, Sep. 2013, 4 pages.

Zhan Ying et al., "Design on a Novel Dual-band Feed," Radio Communications Technology, Feb. 14, 2015, 5 pages (English abstract).

Extended European Search Report issued in European Application No. 20187178.7 dated Jan. 19, 2021, 11 pages.

* cited by examiner $TM_{11}$ $TE_{11}+TM_{11}$

DUAL-BAND ANTENNA

CROSS-REFERENCE TO RELATED APPLICATIONS

This application is a continuation of U.S. patent application Ser. No. 16/134,519, filed on Sep. 18, 2018, which is a continuation of International Application No. PCT/CN2017/072085, filed on Jan. 22, 2017. All of the aforementioned patent applications are hereby incorporated by reference in their entireties.

TECHNICAL FIELD

The present application relates to the field of wireless communications, and in particular, to a coaxial dual-band antenna that can be used in a dual-band parabolic antenna.

BACKGROUND

With rapid development of wireless communications technologies, a transmission capacity in microwave point-to-point communication continuously increases, and an E-band (71 to 76 GHz, 81 to 86 GHz) frequency band microwave device plays an increasingly important role in a base station backhaul network. However, because "rain fade" on an E-band frequency band electromagnetic wave is extremely severe, an E-band microwave single-hop distance is usually less than 3 kilometers. To increase the E-band microwave single-hop distance and reduce site deployment costs, a solution is provided, in which the E-band frequency band microwave device and another low frequency microwave device are cooperatively used. When there is relatively heavy rain, even if the E-band microwave device cannot normally work, the low frequency microwave device can still normally work.

A dual-band parabolic antenna is used in this solution, and a structure of the dual-band parabolic antenna is shown in FIG. 1. The dual-band parabolic antenna includes a primary reflector, a secondary reflector, a low frequency feed, and a high frequency feed. The high frequency feed is inserted into the low frequency feed, and the two feeds use a same axis, and form a coaxial dual-band antenna. The two feeds of the coaxial dual-band antenna share the primary reflector and the secondary reflector, and phase centers of the two feeds are overlapped at a focus of the secondary reflector, so as to implement a dual-band multiplexing function.

In the prior art, a low frequency feed of a coaxial dual-band antenna is usually in a shape of a large-mouth horn, and a dielectric pin needs to be inserted into a high frequency feed. Both the high frequency feed and the low frequency feed have problems that radiation efficiency is relatively low, and a gain cannot reach a gain level of a single-band antenna.

SUMMARY

Embodiments of the present application provide a coaxial dual-band antenna. A circular waveguide with an unchanged diameter or a circular waveguide with a small flare angle is used to replace a large-mouth horn-shaped waveguide and serves as a low frequency feed, so as to resolve problems that radiation efficiency of a high frequency feed and a low frequency feed in an existing coaxial dual-band antenna is relatively low, and a gain cannot reach a gain level of a single-band antenna.

According to a first aspect, a coaxial dual-band antenna is provided and includes a waveguide tube, a ring groove, a high frequency feed, and a dielectric ring, where the waveguide tube has a tubular structure, and is configured to transmit a first electromagnetic wave, the ring groove whose opening direction is the same as an output direction of the first electromagnetic wave is on a wall of the waveguide tube, and a frequency of the first electromagnetic wave is lower than a frequency of an electromagnetic wave transmitted by the high frequency feed; the high frequency feed is located in the waveguide tube, and has a same axis with the waveguide tube, and the first electromagnetic wave excites a transverse electric mode $TE_{11}$ in the waveguide tube; and; and the dielectric ring is filled between the waveguide tube and the high frequency feed, the dielectric ring has a multi-layer structure, and has a same axis with the waveguide tube, area sizes of planes that are at layers of the dielectric ring and that are perpendicular to the axis alternately change, and a height of the dielectric ring is less than a height of the waveguide tube.

The coaxial dual-band antenna provided in the embodiments of the present application excites the $TE_{11}$ mode of the first electromagnetic wave at a low frequency, and no high order mode is generated inside the waveguide tube. This avoids a transmission loss of a high order mode in the waveguide, and improves low frequency radiation efficiency of the dual-band antenna. In addition, because no high order mode is generated inside the waveguide tube, there is no need to worry about that the high frequency feed located in the waveguide tube affects electromagnetic field distribution of the high order mode. Therefore, a dielectric pin can be omitted, and high frequency radiation efficiency of the dual-band antenna can be improved.

With reference to the first aspect, in a first possible implementation of the first aspect, a height of the high frequency feed is the same as the height of the waveguide tube.

With reference to the first aspect, in a second possible implementation of the first aspect, a sum of a radius of an inner wall of the waveguide tube and a radius of an outer wall of the high frequency feed is greater than $1/\pi$ of a wavelength of the first electromagnetic wave, and a difference between the two radiuses is less than ½ of the wavelength of the first electromagnetic wave. In the embodiments, it can be ensured that only the $TE_{11}$ mode is exited in the antenna, and a mode of a higher order does not exist, and therefore, a transmission loss of a high order mode in a waveguide is avoided.

With reference to the first aspect, or the first or the second possible implementation of the first aspect, in a third possible implementation of the first aspect, a difference between a radius of the ring groove and the radius of the inner wall of the waveguide tube is ⅛ of the wavelength of the first electromagnetic wave.

With reference to the third possible implementation of the first aspect, in a fourth possible implementation of the first aspect, a depth of the ring groove is between ⅕ and ¼ of the wavelength of the first electromagnetic wave, and a width of the ring groove is ⅛ of the wavelength of the first electromagnetic wave.

Size requirements of the ring groove are provided in the foregoing two implementations. A high order mode excited by a ring groove meeting the size requirements may be overlaid with the $TE_{11}$ mode, so that a beam width of the first electromagnetic wave on an E plane is consistent with that on an H plane, and radiation efficiency of the first electromagnetic wave is maximized.

With reference to any one of the first aspect, or the first to the fourth possible implementations of the first aspect, in a fifth possible implementation of the first aspect, an outer wall at only one of two adjacent layers of the dielectric ring is connected to the inner wall of the waveguide tube, and an inner wall at the layer of the dielectric ring is connected to the outer wall of the high frequency feed. This can implement sealing and waterproof functions, and can fasten the high frequency feed.

With reference to any one of the first aspect, or the first to the fifth possible implementations of the first aspect, in a sixth possible implementation of the first aspect, a layer that is of the dielectric ring and that is farthest from an output plane of the waveguide tube is not connected to the waveguide tube and the high frequency feed at a same time. This can reduce reflection of the first electromagnetic wave on the dielectric ring, and improve radiation efficiency.

With reference to the sixth possible implementation of the first aspect, in a seventh possible implementation of the first aspect, a height of each layer of the dielectric ring is ¼ of the wavelength of the first electromagnetic wave.

With reference to the sixth or the seventh possible implementation of the first aspect, in an eighth possible implementation of the first aspect, a relative dielectric constant of the dielectric ring is between 2 and 4.

The height of each layer of the dielectric ring and the relative dielectric constant are described in the foregoing two implementations. The height of each layer of the dielectric ring and the relative dielectric constant enable characteristic impedance of the coaxial dual-band antenna and wave impedance of free space to match each other, and improve the radiation efficiency.

The coaxial dual-band antenna provided in the present application excites a $TE_{11}$ mode of a first electromagnetic wave at a low frequency, and no high order mode is generated inside a waveguide tube. This avoids a transmission loss of a high order mode in the waveguide, and improves low frequency radiation efficiency of the dual-band antenna. In addition, because no high order mode is generated inside the waveguide tube, there is no need to worry about that a high frequency feed located in the waveguide tube affects electromagnetic field distribution of the high order mode. Therefore, a dielectric pin can be omitted, and high frequency radiation efficiency of the dual-band antenna can be improved.

BRIEF DESCRIPTION OF DRAWINGS

FIG. 3 (*b*) is a schematic structural diagram of a coaxial dual-band antenna according to another embodiment of the present application;

FIG. 3 (*c*) is a schematic structural diagram of a coaxial dual-band antenna according to another embodiment of the present application;

FIG. 4 (*b*) is a distribution diagram of an electric field of a $TM_{11}$ mode in a coaxial dual-band antenna according to an embodiment of the present application;

FIG. 4 (*c*) is a distribution diagram of an electric field obtained after a $TE_{11}$ mode and a $TM_{11}$ mode in a coaxial dual-band antenna are overlaid according to an embodiment of the present application;

FIG. 5 (*b*) is a schematic structural diagram of a coaxial dual-band antenna according to another embodiment of the present application;

FIG. 6 (*b*) is a schematic structural diagram of a coaxial dual-band antenna according to another embodiment of the present application;

FIG. 7 (*b*) is a schematic structural diagram of a coaxial dual-band antenna according to another embodiment of the present application;

FIG. 8 (*b*) is a schematic structural diagram of a coaxial dual-band antenna according to another embodiment of the present application.

DESCRIPTION OF EMBODIMENTS

The following describes the technical solutions in the embodiments of this application with reference to the accompanying drawings in the embodiments of this application.

Figure 1:
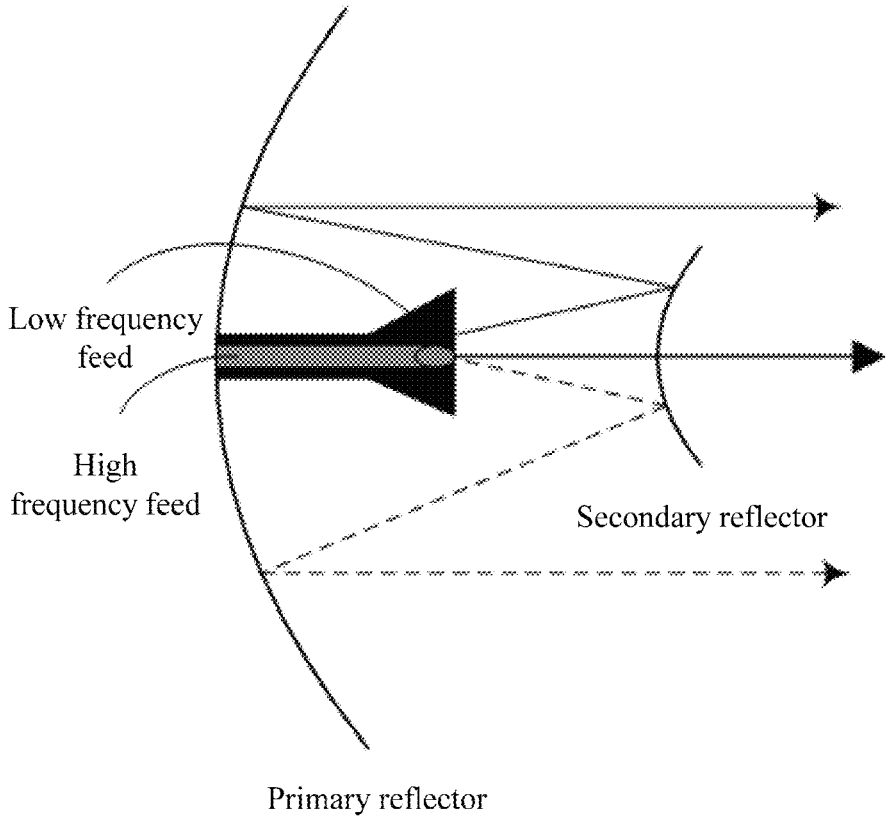
FIG. 1 (Prior Art)
FIG. 1 is a schematic structural diagram of an existing dual-band parabolic antenna.
Figure 2:
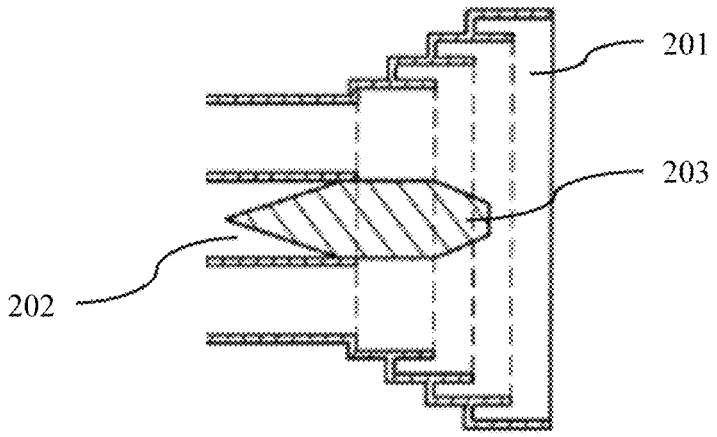
FIG. 2 (Prior Art)
FIG. 2 is a schematic structural diagram of an existing coaxial dual-band antenna.

A structure of an existing coaxial dual-band antenna is show in FIG. 2. A low frequency feed 201 of the coaxial dual-band antenna is a large-mouth horn-shaped waveguide, a high frequency feed 202 is included in the waveguide, and a dielectric pin 203 is inserted into the high frequency feed 202. The horn-shaped waveguide is used to facilitate matching between characteristic impedance of the waveguide and wave impedance of free space, so as to reduce reflection. As a radius of the waveguide increases, a high order mode is excited, and the high order mode and a transverse electric mode $TE_{11}$ take effect, so that a beam width of an output electromagnetic wave on an E plane is consistent with that on an H plane, and a best gain effect is achieved. The E plane is a plane including a direction in which an electric field is located and a direction with highest radiation intensity, and the H plane is a plane including a direction in which a magnetic field is located and the direction with the highest radiation intensity. However, the high order mode is generated inside the large-mouth horn-shaped waveguide, and a transmission loss in the waveguide is relatively large. Therefore, low frequency radiation efficiency of the dual-band antenna is relatively low.

The high frequency feed is metallic, and affects electromagnetic field distribution of the high order mode. Therefore, the high frequency feed cannot directly extend to an aperture of the large-mouth horn-shaped waveguide, and a dielectric pin needs to guide a phase center of the high frequency feed to the aperture of the large-mouth horn-shaped waveguide. However, processing of the dielectric pin is uneasy, and a loss of the dielectric pin is relatively large. Therefore, a high frequency gain of the dual-band antenna cannot reach a level of a single-band antenna, either.

Figure 3:
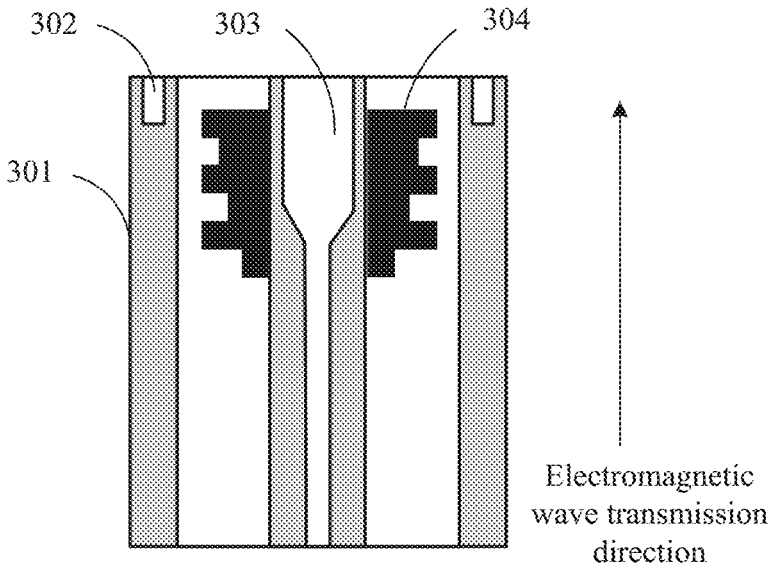
FIG. 3 (*a*) is a schematic structural diagram of a coaxial dual-band antenna according to an embodiment of the present application.
Figure 3:
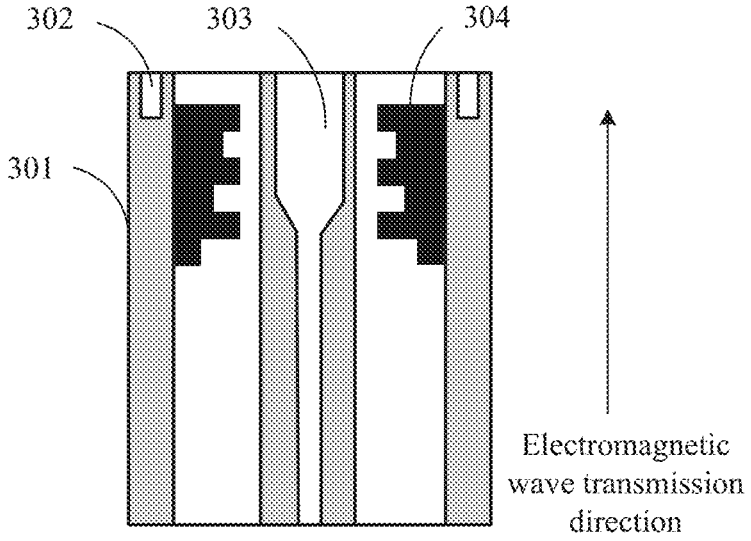
Figure 3:
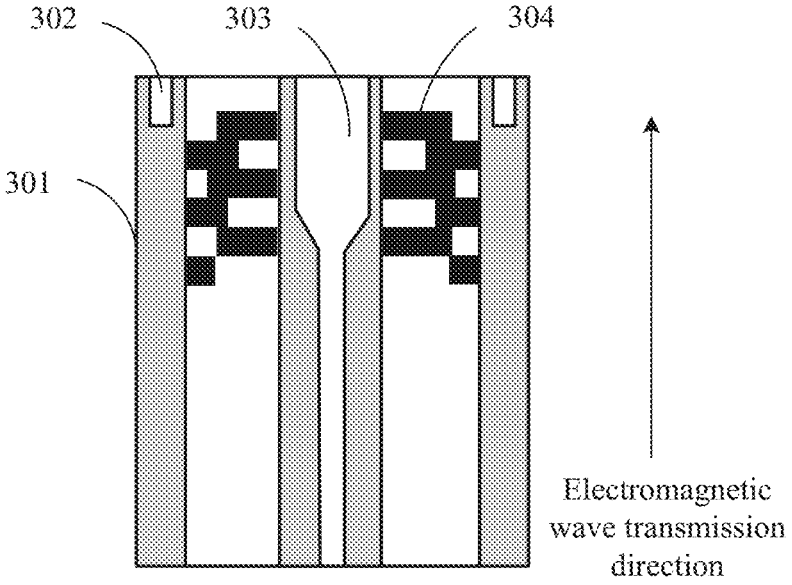

An embodiment of the present application provides a coaxial dual-band antenna. As shown in FIG. 3 (*a*), the antenna includes a waveguide tube 301, a ring groove 302, a high frequency feed 303, and a dielectric ring 304.

The waveguide tube 301 has a tubular structure, and is configured to transmit a first electromagnetic wave, the ring groove 302 whose opening direction is the same as an output direction of the first electromagnetic wave is on a wall of the waveguide tube 301, and a frequency of the first electromagnetic wave is lower than a frequency of an electromagnetic wave transmitted by the high frequency feed 303.

The high frequency feed 303 is located in the waveguide tube 301, and has a same axis with the waveguide tube 301, and the first electromagnetic wave excites a transverse electric mode $TE_{11}$ in the waveguide tube 301.

The dielectric ring 304 is filled between the waveguide tube 301 and the high frequency feed 303. The dielectric ring 304 has a multi-layer structure, and has a same axis with the waveguide tube 301. Area sizes of planes that are at layers of the dielectric ring 304 and that are perpendicular to the axis alternately change. A height of the dielectric ring 304 is less than a height of the waveguide tube 301.

Optionally, a height of the high frequency feed 303 is the same as the height of the waveguide tube 301. It should be understood that, it is also feasible if the height of the high frequency feed is slightly less than the height of the waveguide tube.

In this embodiment of the present application, a waveguide tube excites a $TE_{11}$ mode of a first electromagnetic wave at a low frequency, and no high order mode is generated inside the waveguide tube. This avoids a transmission loss of a high order mode in the waveguide, and improves low frequency radiation efficiency of a dual-band antenna. In addition, because no high order mode is generated inside the waveguide tube, there is no need to worry about that a high frequency feed located in the waveguide tube affects electromagnetic field distribution of the high order mode. Therefore, a dielectric pin can be omitted, and high frequency radiation efficiency of the dual-band antenna can be improved.

It should be understood that, in the coaxial dual-band antenna shown in FIG. 3 (*a*), an inner wall of the dielectric ring 304 is connected to an outer wall of the high frequency feed 303. This is only a possible structure of the coaxial dual-band antenna provided in the present application. Provided that area sizes of planes that are at layers of the dielectric ring 304 and that are perpendicular to the axis alternately change, alternatively, as shown in FIG. 3 (*b*), in the antenna, an outer wall of the dielectric ring 304 may be connected to an inner wall of the waveguide tube 301; or, as shown in FIG. 3 (*c*), an inner wall at one or more layers of the dielectric ring 304 may be connected to an outer wall of the high frequency feed 303, and an outer wall at a remaining layer of the dielectric ring is connected to an inner wall of the waveguide tube 301.

It should be noted that, electromagnetic field distribution on a cross section of a waveguide is referred to as a propagation mode of the waveguide. Different propagation modes have different cut-off wavelengths, a mode without a cut-off wavelength or with a longest cut-off wavelength is referred to as a dominant mode or a base mode, and another mode with a shorter cut-off wavelength is referred to as a high order mode. A higher order of a propagation mode indicates a shorter cut-off wavelength. In this embodiment of the present application, the $TE_{11}$ mode is used as the base mode, and another mode with a cut-off wavelength shorter than that of the $TE_{11}$ mode is referred to as a high order mode.

It should be understood that, the waveguide tube provided in this embodiment of the present application may be in a shape of a cylinder, a rectangular tube, or the like. A mouth for outputting the first electromagnetic wave may be slightly expanded, provided that only the base mode of the first electromagnetic wave is excited in the coaxial dual-band antenna including the waveguide tube, the high frequency feed, the ring groove, and the dielectric ring. A wall of the waveguide tube is usually metallic.

Optionally, a sum of a radius of the inner wall of the waveguide tube 301 and a radius of the outer wall of the high frequency feed 303 is greater than $1/\pi$ of a wavelength of the first electromagnetic wave, a difference between the two radiuses is less than ½ of the wavelength of the first electromagnetic wave, and a frequency of the first electromagnetic wave is lower than a frequency of an electromagnetic wave transmitted by the high frequency feed 303.

Specifically, the coaxial waveguide including the high frequency feed 303 and the waveguide tube 301 in the present application is used as an example. Cut-off wavelengths of the first electromagnetic wave in different modes are related to an outer radius a of an inner waveguide (the radius of the outer wall of the high frequency feed 303) and an inner radius b of an outer waveguide (the radius of the inner wall of the waveguide tube 301) in the coaxial waveguide. A correspondence is listed in Table 1.

TABLE 1

| Propagation mode | Cut-off wavelength |
|---|---|
| TEM | No cut-off wavelength |
| $TE_{11}$ | $\pi \times (b + a)$ |
| $TM_{m1}$ (m = 0, 1, 2 . . . ) $TE_{01}$ | $2 \times (b - a)$ |
| $TE_{21}$ | $\pi \times (b + a)/2$ |
| $TE_{m1}$ (m = 3, 4, 5 . . . ) | $\pi \times (b + a)/m$ |
| $TM_{m2}$, $TE_{02}$ | $b - a$ |
| $TM_{mn}$ (n = 3, 4, 5 . . . ), $TE_{0n}$ (n = 3, 4, 5 . . . ) | $2 \times (b - a)/n$ |

If the wavelength of the first electromagnetic wave is $\lambda$, it can be learned from Table 1 that the first electromagnetic wave may excite the $TE_{11}$ mode if the coaxial waveguide meets a condition in which $(b+a)>\lambda/\pi$ and $(b-a)<\lambda/2$. If b in the coaxial waveguide becomes larger, and consequently $(b-a)>\lambda/2$ and $(b+a)<2\lambda/\pi$, the first electromagnetic wave may excite modes such as $TE_{11}$, $TM_{m1}$, and $TE_{01}$ in theory. However, a continuous tangential component needs to be ensured when an electromagnetic field mode changes, that is, m needs to be consistent. Therefore, only two modes actually exist: $TE_{11}$ and $TM_{11}$. As the inner radius b of the outer waveguide in the coaxial waveguide increases, more modes exist gradually.

It should be noted that, a transverse electromagnetic mode (TEM) may also exist in the coaxial waveguide, and no cut-off wavelength exists in this mode or a cut-off wavelength in this mode is infinitely long. However, before being excited in the coaxial dual-band antenna, the TEM mode is suppressed in a symmetrical feeding manner. Therefore, this mode is not considered in this embodiment of the present application.

Figure 4:
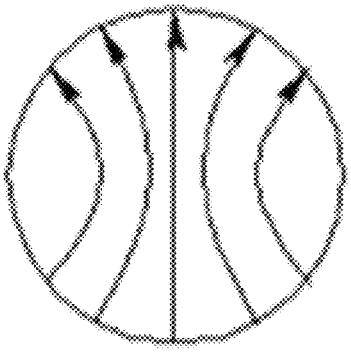
FIG. 4 (*a*) is a distribution diagram of an electric field of a $TE_{11}$ mode in a coaxial dual-band antenna according to an embodiment of the present application.
Figure 4:
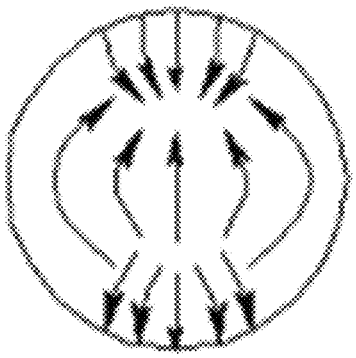
Figure 4:
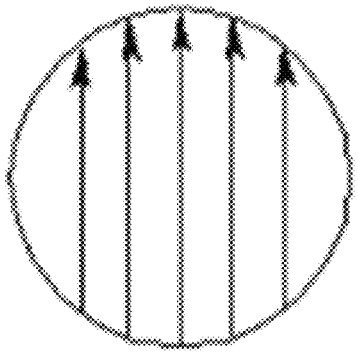

Further, as shown in FIG. 4 (*a*), only the $TE_{11}$ mode exists in the waveguide tube, and electric field distribution of the $TE_{11}$ mode in the waveguide tube is non-uniform, that is, electric field distribution of the first electromagnetic wave is non-uniform. Therefore, a beam width of the first electromagnetic wave on the E plane is inconsistent with that on the H plane. For the foregoing problem, in this embodiment of the present application, the ring groove 302 whose opening direction is the same as the output direction of the first electromagnetic wave is excavated on the wall of the waveguide tube 301, a high order mode is excited by using discontinuity of the wall of the waveguide tube 301, and the high order mode is used to make the electric field distribution of the $TE_{11}$ mode become uniform. A depth and a width of the ring groove 302 and a distance from the ring groove 302 to the inner wall of the waveguide tube 301 all affect an order and amplitude of the high order mode.

Optionally, a difference between a radius of the ring groove 302 and the radius of the inner wall of the waveguide tube 301 is ⅛ of the wavelength of the first electromagnetic wave. The depth of the ring groove 302 is between ⅕ and ¼ of the wavelength of the first electromagnetic wave, and the width of the ring groove 302 is ⅛ of the wavelength of the first electromagnetic wave. Specifically, at a location that is on a wall plane at an output end of the waveguide tube and whose distance with the inner wall of the waveguide tube is ⅛ of the wavelength of the first electromagnetic wave, a ring whose width and depth meet the foregoing requirements is excavated on the wall, to form the ring groove 302. The ring groove 302 causes discontinuity on a surface of the wall, so that the high order mode is excited. The location, the width, and the depth of the ring groove 302 meet the foregoing requirements, so that the high order mode $TM_{11}$ with an appropriate amplitude can be generated. Electric field distribution of the $TM_{11}$ mode is shown in FIG. 4 (*b*). As shown in FIG. 4 (*c*), the $TE_{11}$ mode and the $TM_{11}$ mode are overlaid, so that the electric field distribution of the first electromagnetic wave becomes uniform. Consequently, the beam width of the first electromagnetic wave on the F plane is consistent with that on the H plane, and a gain effect is maximized.

In addition, a large-mouth horn-shaped waveguide is omitted in this embodiment of the present application. Therefore, characteristic impedance of the coaxial dual-band antenna and wave impedance of free space cannot match each other by gradually changing the characteristic impedance at the output end of the waveguide tube by using a gradually increasing diameter of the waveguide tube. In this embodiment of the present application, impedance matching may be implemented in the following two manners.

(1) The dielectric ring 304 filled between the waveguide tube 301 and the high frequency feed 303 is used to implement impedance matching. The dielectric ring 304 has the multi-layer structure, and has the same axis with the waveguide tube 301. The area sizes of the planes that are at the layers of the dielectric ring 304 and that are perpendicular to the axis alternately change. The height of the dielectric ring 304 is less than the height of the waveguide tube 301. The structure of the dielectric ring 304 may be any structure shown in FIG. 3 (*a*), FIG. 3 (*b*), and FIG. 3 (*c*).

According to an impedance matching principle, when load impedance and characteristic impedance of a waveguide are inconsistent, to ensure that energy is transferred to a load and is not reflected back, a matching section is required between the load and the waveguide. When characteristic impedance $Z_0$ of the matching section meets the following formula, the characteristic impedance of the waveguide is equal to the load impedance after being converted by the matching section.

$$Z_0=\sqrt{R_0R_L} \quad (1)$$

$R_0$ is the characteristic impedance of the waveguide, and $R_L$ is the load impedance.

In this embodiment of the present invention, the load impedance is the wave impedance of the free space, and the characteristic impedance of the waveguide is the characteristic impedance of the coaxial dual-band antenna. The characteristic impedance of the waveguide tube can be changed by filling a dielectric in the waveguide tube. That is, the filled dielectric ring forms the matching section. However, if the waveguide tube is fully filled with the dielectric, in the waveguide tube, a sudden change of the characteristic impedance occurs on a contact surface between the dielectric and the air, and there is strong reflection.

The dielectric ring 304 used in the present application does not fully fill a gap between the waveguide tube 301 and the high frequency feed 303, but uses the multi-layer structure having the same axis with the waveguide tube 301. The area sizes of the planes that are at the layers of the dielectric ring 304 and that are perpendicular to the axis alternately change, to form a mixture of the dielectric and the air. Therefore, an equivalent relative dielectric constant is no longer equal to a relative dielectric constant of a material, and can be controlled and changed. A purpose of such control and change is to enable the characteristic impedance of the matching section to reach a value obtained by means of calculation by using the foregoing formula.

Optionally, a height of each layer of the dielectric ring 304 is ¼ of the wavelength of the first electromagnetic wave, and the first electromagnetic wave is a low frequency electromagnetic wave transmitted by the coaxial dual-band antenna.

Figure 5:
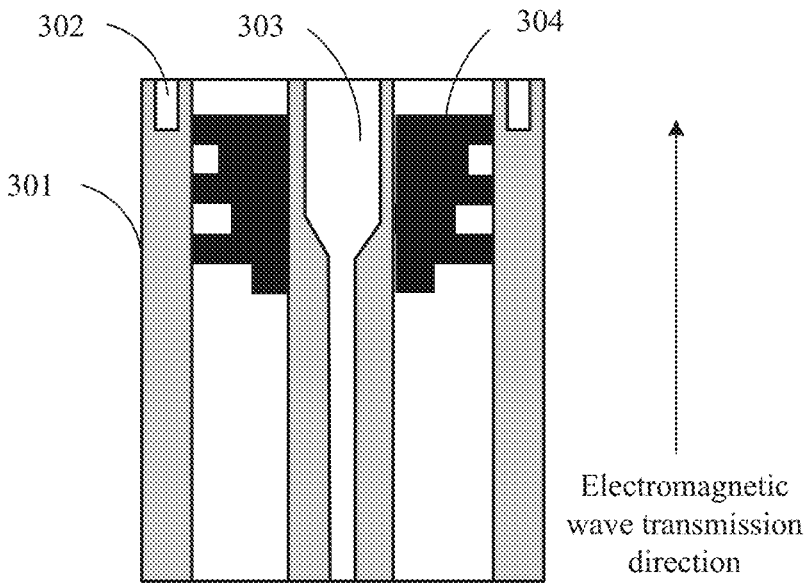
FIG. 5 (*a*) is a schematic structural diagram of a coaxial dual-band antenna according to another embodiment of the present application.
Figure 5:
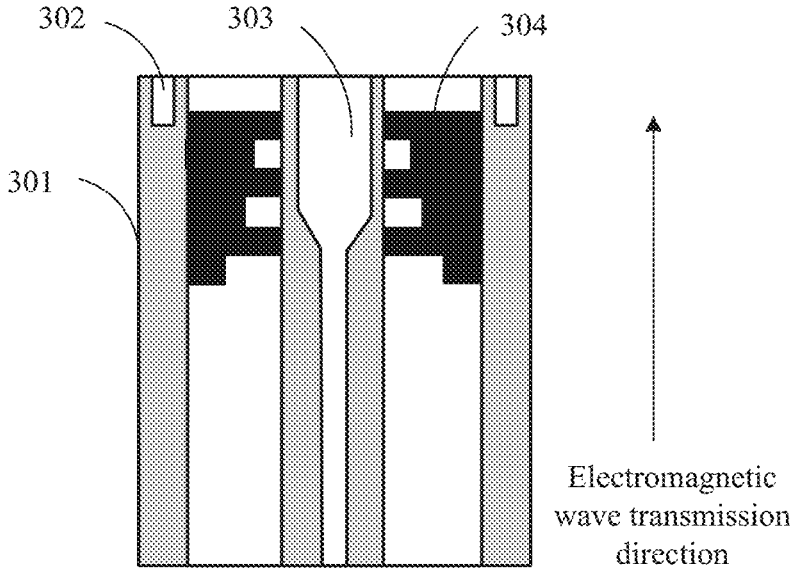

Optionally, in a structure shown in FIG. 5 (*a*) or FIG. 5 (*b*), an outer wall at only one of two adjacent layers of the dielectric ring 304 is connected to the inner wall of the waveguide tube 301, and an inner wall at the layer of the dielectric ring 304 is connected to the outer wall of the high frequency feed 303. In this way, inner walls at multiple layers of the dielectric ring 304 are connected to the outer wall of the high frequency feed 303, and outer walls at the multiple layers of the dielectric ring 304 are connected to the inner wall of the waveguide tube 301. This can implement air sealing and waterproof functions, and can fasten the high frequency feed 303 in between. Consequently, the coaxial dual-band antenna not only can be applied to satellite communication, but also is applicable to the ground. Other than the layers of the dielectric ring that are connected to both the waveguide tube 301 and the high frequency feed 303, spacing between an inner wall and an outer wall at another layer of the dielectric ring 304 needs to be designed and optimized according to the foregoing equivalent dielectric constant principle.

Optionally, a layer that is of the dielectric ring 304 and that is farthest from an output plane of the waveguide tube 301 is not connected to the waveguide tube 301 and the high frequency feed 303 at a same time, so as to reduce reflection of the first electromagnetic wave. The layer that is of the dielectric ring and that is farthest from the output plane is a bottom layer of the dielectric ring shown in FIG. 5 (*a*) and FIG. 5 (*b*).

A dielectric material whose relative dielectric constant is between 2 and 4 may be used for the dielectric ring in this embodiment of the present application, for example, polycarbonate, polystyrene, and polytetrafluorethylene. A specific material is not limited in this embodiment of the present application.

After the material is determined, spacing between an inner wall and an outer wall at each layer of the dielectric ring 304 is further related to the wavelength of the first electromagnetic wave. The following provides a specific embodiment in which the frequency of the first electromagnetic wave is 18 GHz. It is assumed that polycarbonate whose relative dielectric constant is 2.8 is used to prepare the dielectric ring, the radius of the inner wall of the waveguide tube is R, and the dielectric ring has six layers. As shown in FIG. 5 (*a*), radius lengths of layers of the dielectric ring alternately change from top to bottom radiuses of outer walls at the first layer, the third layer, and the fifth layer of the dielectric ring are R, a radius of an outer wall at the second layer of the dielectric ring is 0.78 R, a radius of an outer wall at the fourth layer of the dielectric ring is 0.7 R, and a radius of an outer wall at the sixth layer of the dielectric ring is 0.7 R. The characteristic impedance of the matching section can meet formula (1) by using the dielectric ring with the foregoing sizes, so that the characteristic impedance of the coaxial dual-band antenna and the wave impedance of the free space match each other, electromagnetic wave reflection is reduced, and radiation efficiency is improved.

Figure 6:
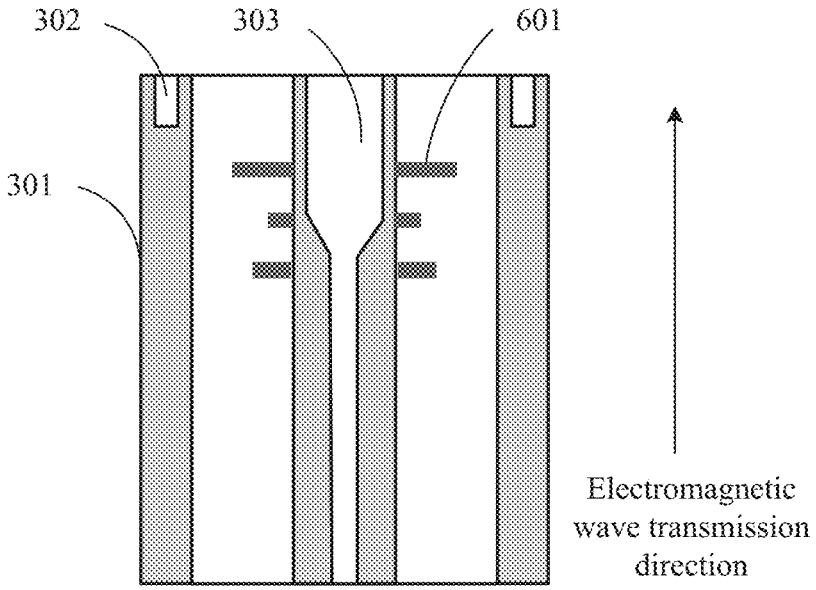
FIG. 6 (*a*) is a schematic structural diagram of a coaxial dual-band antenna according to another embodiment of the present application.
Figure 6:
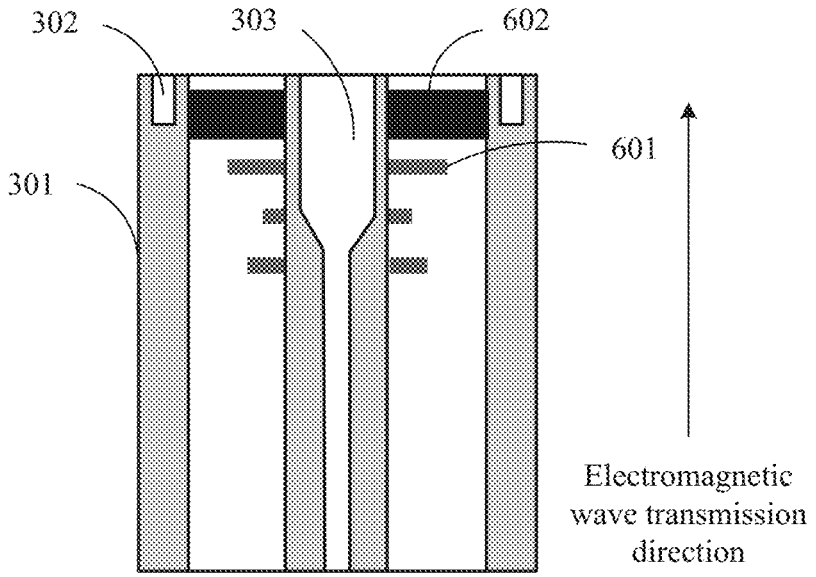

(2) Multiple metal rings 601 are disposed in the waveguide tube to implement impedance matching. The metal rings form a matching section. A possible structure is shown in FIG. 6 (*a*), and an inner wall of each metal ring 601 is connected to the outer wall of the high frequency feed 303. Equivalent inductance and equivalent capacitance of each metal ring 601 may be changed by changing a radius of each metal ring 601 and spacing between the metal rings 601, so that characteristic impedance of the matching section reaches a value obtained by means of calculation by using formula (1).

Optionally, a dielectric layer 602 may further be filled at a location that is inside the waveguide tube 301 and that is close to the output plane. As shown in FIG. 6 (*b*), an inner wall of the dielectric layer 602 is connected to the outer wall of the high frequency feed 303, and an outer wall of the dielectric layer 602 is connected to the inner wall of the waveguide tube 301. This can implement air sealing and waterproof functions, and can fasten the high frequency feed. A hard material may be used for the dielectric layer 602, and a specific material is not limited in the present application.

Figure 7:
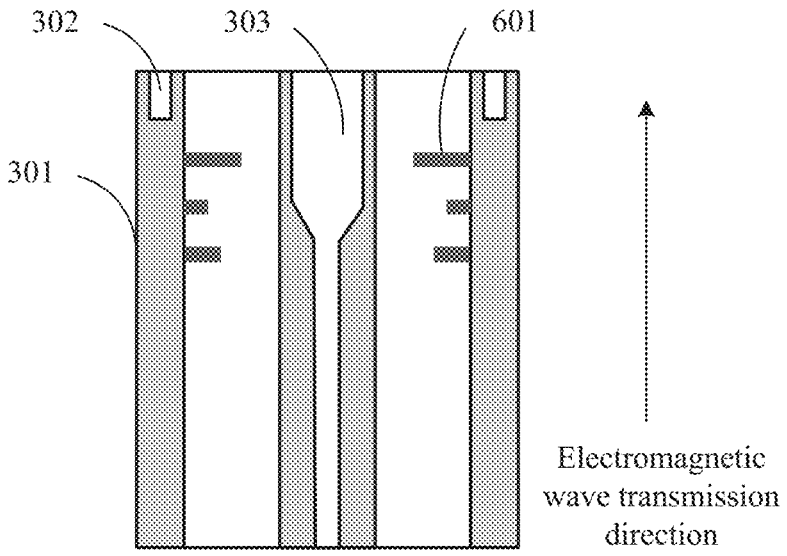
FIG. 7 (*a*) is a schematic structural diagram of a coaxial dual-band antenna according to another embodiment of the present application.
Figure 7:
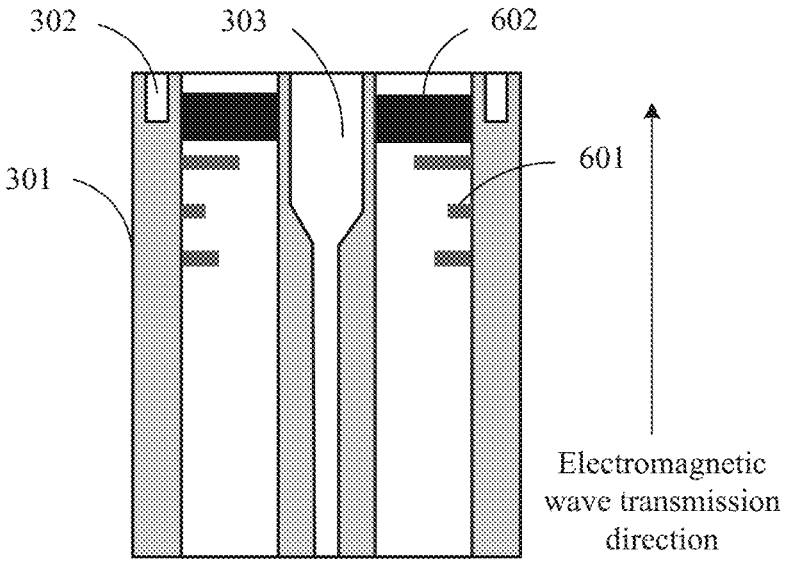
Figure 8:
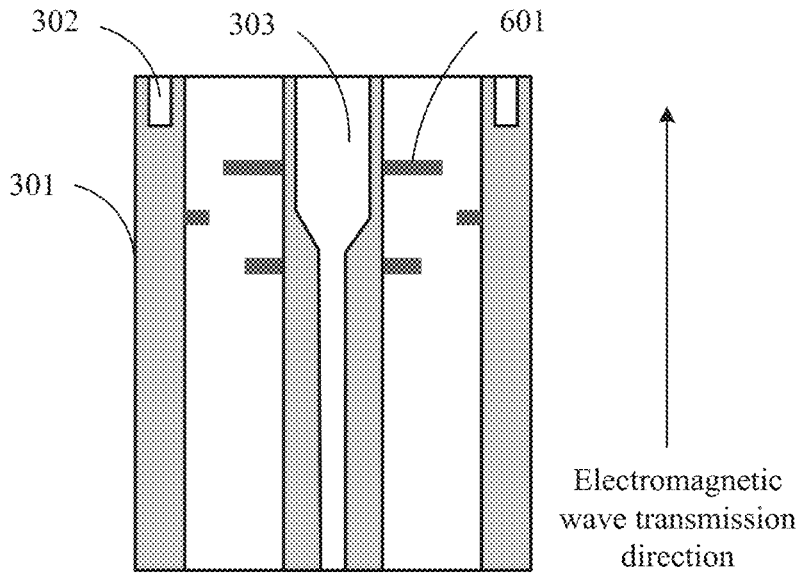
FIG. 8 (*a*) is a schematic structural diagram of a coaxial dual-band antenna according to another embodiment of the present application.
Figure 8:
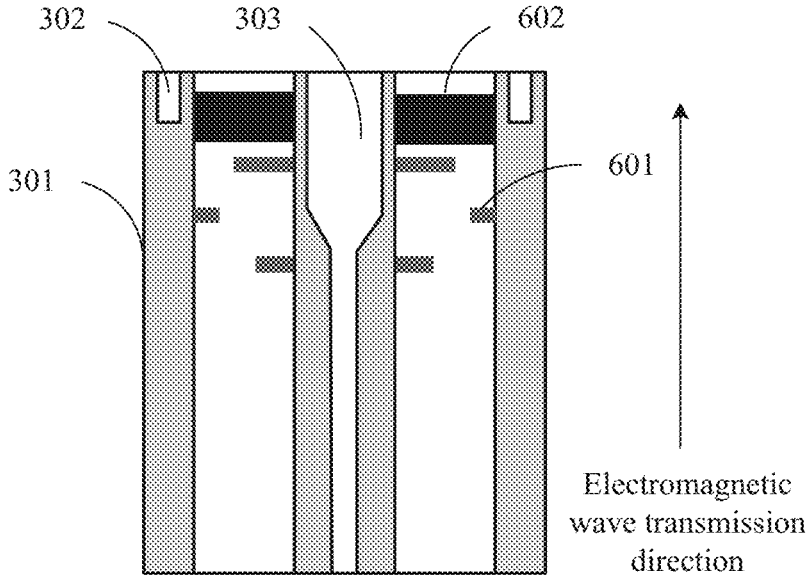

It should be understood that, FIG. 6 (*a*) and FIG. 6 (*b*) show only possible structures in this embodiment of the present application. As shown in FIG. 7(*a*) and FIG. 7 (*b*), outer walls of the metal rings 601 may be connected to the inner wall of the waveguide tube 301, to form a matching section. Alternatively, as shown in FIG. 8 (*a*) and FIG. 8 (*b*), outer walls of some metal rings 601 are connected to the inner wall of the waveguide tube 301, and inner walls of the other part of metal rings 601 are connected to the outer wall of the high frequency feed 303, to form a matching section. A specific implementation is not limited in this embodiment of the present application.

The coaxial dual-band antenna provided in the present application has the following advantages: A waveguide tube 301 excites a $TE_{11}$ mode of a first electromagnetic wave at a low frequency, and no high order mode is generated inside the waveguide tube 301. This avoids a transmission loss of a high order mode in the waveguide tube 301, and improves low frequency radiation efficiency of the dual-band antenna. In addition, because no high order mode is generated inside the waveguide tube 301, there is no need to worry about that a high frequency feed 303 located in the waveguide tube 301 affects electromagnetic field distribution of the high order mode. Therefore, a dielectric pin can be omitted, and high frequency radiation efficiency of the dual-band antenna can be improved. In addition, according to a design of a ring groove 302 and a dielectric ring 304, a beam width of the first electromagnetic wave on an E plane can be consistent with that on an H plane, and characteristic impedance of the coaxial dual-band antenna and wave impedance of free space can match each other.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. A coaxial dual-band antenna, comprising a waveguide tube, a ring groove, a dielectric ring, and a high frequency feed, wherein:

the waveguide tube has a tubular structure and is configured to transmit a first electromagnetic wave, wherein the ring groove whose opening direction is the same as an output direction of the first electromagnetic wave is on a wall of the waveguide tube, and wherein a frequency of the first electromagnetic wave is lower than a frequency of an electromagnetic wave transmitted by the high frequency feed;

the high frequency feed is located in the waveguide tube and has a same axis with the waveguide tube; and the dielectric ring has a multi-layer structure, wherein a height of the dielectric ring is less than a height of the waveguide tube, wherein the dielectric ring has a same axis with the waveguide tube, wherein area sizes of planes that are at layers of the dielectric ring and that are perpendicular to the axis alternately change, wherein an outer wall of at least one of two adjacent layers of the dielectric ring is connected to an inner wall of the waveguide tube, and wherein an inner wall of the at least one of the two adjacent layers of the dielectric ring is connected to an outer wall of the high frequency feed.

2. The coaxial dual-band antenna according to claim 1, wherein a height of the high frequency feed is the same as a height of the waveguide tube.

3. The coaxial dual-band antenna according to claim 1, wherein a sum of a radius of an inner wall of the waveguide tube and a radius of an outer wall of the high frequency feed is greater than $1/\pi$ of a wavelength of the first electromagnetic wave, and wherein a difference between the two radiuses is less than ½ of the wavelength of the first electromagnetic wave.

4. The coaxial dual-band antenna according to claim 1, wherein a difference between a radius of the ring groove and a radius of an inner wall of the waveguide tube is ⅛ of a wavelength of the first electromagnetic wave.

5. The coaxial dual-band antenna according to claim 4, wherein a depth of the ring groove is between ⅕ and ¼ of the wavelength of the first electromagnetic wave, and wherein a width of the ring groove is ⅛ of the wavelength of the first electromagnetic wave.

6. The coaxial dual-band antenna according to claim 1, wherein a layer that is of the dielectric ring and that is farthest from an output plane of the waveguide tube is not connected to the waveguide tube and the high frequency feed at a same time.

7. The coaxial dual-band antenna according to claim 1, wherein a height of each layer of the dielectric ring is ¼ of a wavelength of the first electromagnetic wave.

8. The coaxial dual-band antenna according to claim 1, wherein a relative dielectric constant of the dielectric ring is between 2 and 4.

9. A dual-band parabolic antenna, comprising:

a primary reflector;

a secondary reflector; and a coaxial dual-band antenna, the coaxial dual-band antenna comprising a waveguide tube, a ring groove, a dielectric ring, and a high frequency feed, wherein:

the waveguide tube has a tubular structure, and is configured to transmit a first electromagnetic wave, wherein the ring groove whose opening direction is the same as an output direction of the first electromagnetic wave is on a wall of the waveguide tube, and wherein a frequency of the first electromagnetic wave is lower than a frequency of an electromagnetic wave transmitted by the high frequency feed;

the high frequency feed is located in the waveguide tube, and has a same axis with the waveguide tube, and wherein the first electromagnetic wave excites a transverse electric mode TE11 in the waveguide tube; and the dielectric ring has a multi-layer structure, wherein a height of the dielectric ring is less than a height of the waveguide tube, wherein the dielectric ring has a same axis with the waveguide tube, wherein area sizes of planes that are at layers of the dielectric ring and that are perpendicular to the axis alternately change, wherein an outer wall of at least one of two adjacent layers of the dielectric ring is connected to an inner wall of the waveguide tube, and wherein an inner wall of the at least one of the two adjacent layers of the dielectric ring is connected to an outer wall of the high frequency feed.

10. The dual-band parabolic antenna according to claim 9, wherein a height of the high frequency feed is the same as a height of the waveguide tube.

11. The dual-band parabolic antenna according to claim 9, wherein a sum of a radius of an inner wall of the waveguide tube and a radius of an outer wall of the high frequency feed is greater than $1/\pi$ of a wavelength of the first electromagnetic wave, and wherein a difference between the two radiuses is less than ½ of the wavelength of the first electromagnetic wave.

12. The dual-band parabolic antenna according to claim 9, wherein a difference between a radius of the ring groove and a radius of an inner wall of the waveguide tube is ⅛ of a wavelength of the first electromagnetic wave.

13. The dual-band parabolic antenna according to claim 12, wherein a depth of the ring groove is between ⅕ and ¼ of the wavelength of the first electromagnetic wave, and wherein a width of the ring groove is ⅛ of the wavelength of the first electromagnetic wave.

14. The dual-band parabolic antenna according to claim 9, wherein a layer that is of the dielectric ring and that is farthest from an output plane of the waveguide tube is not connected to the waveguide tube and the high frequency feed at a same time.

15. The dual-band parabolic antenna according to claim 9, wherein a height of each layer of the dielectric ring is ¼ of a wavelength of the first electromagnetic wave.

16. The dual-band parabolic antenna according to claim 9, wherein a relative dielectric constant of the dielectric ring is between 2 and 4.

* * * * *